United States Patent [19]

Meiser et al.

[11] Patent Number: 4,570,936

[45] Date of Patent: Feb. 18, 1986

[54] JIGSAW PUZZLE

[75] Inventors: Sue M. Meiser, Lafayette; Michael F. Cassidy, West Lafayette, both of Ind.

[73] Assignee: Warren Company, Lafayette, Ind.

[21] Appl. No.: 604,457

[22] Filed: Apr. 27, 1984

[51] Int. Cl.[4] ..... A63F 9/12; A63F 9/10

[52] U.S. Cl. ..... 273/157 R

[58] Field of Search ..... 273/157 R

[56] References Cited

U.S. PATENT DOCUMENTS 1,229,580 6/1917 Brown ..... 273/157 R 2,731,766 1/1956 Rubin ..... 273/157 R X 2,953,380 9/1960 Hassenbech ..... 273/157 R

FOREIGN PATENT DOCUMENTS 2278370 2/1976 France ..... 273/157 R 1521607 8/1978 United Kingdom ..... 273/157 R

*Primary Examiner*—Anton O. Oechsle

[57] ABSTRACT

A jigsaw puzzle includes puzzle pieces which interlock to provide a two-piece part which is provided with an open slot. A plurality of such two-piece parts can be interfitted together to form a three-dimensional object.

4 Claims, 9 Drawing Figures

JIGSAW PUZZLE

BACKGROUND AND SUMMARY

This invention relates to jigsaw puzzles, and, more particularly, to a jigsaw puzzle which includes pieces which can be interlocked to form a two-part piece having a slot. A plurality of such two-part pieces can be interfitted together to form a three-dimensional object.

Jigsaw puzzles have been provided which include pieces which interlock to form three-dimensional figures. For example, British Pat. No. 1,521,607 describes such a puzzle.

A problem arises, however, when it is desired to form puzzle pieces which can interlock to form a slotted part and which can also interlock to form a flat, solid puzzle. If a flat panel is cut to provide the jigsaw pieces and the slots, the pieces which form the slots are small and do not interlock with adjacent pieces. These pieces ruin the integrity of the puzzle. Another problem is that when two pieces are interlocked to form a slotted part, the interlock is frequently weak and does not provide a stable structural part.

The invention provides a flat, solid jigsaw puzzle without slots or openings but which includes pieces which can be interlocked to form slotted two-piece parts. This is accomplished by cutting the panel so that the two pieces which interlock to form the slot are not adjacent to each other. The flat, solid puzzle is imprinted with a scene or other picture and has no slots or openings. However, selected pieces can be removed from the puzzle and interlocked to form a slotted part. A plurality of such slotted parts can be interfitted to form a three-dimensional object. The pieces include diamond-shaped interlocking male projections and female recesses which provide tight and stable interlocks.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
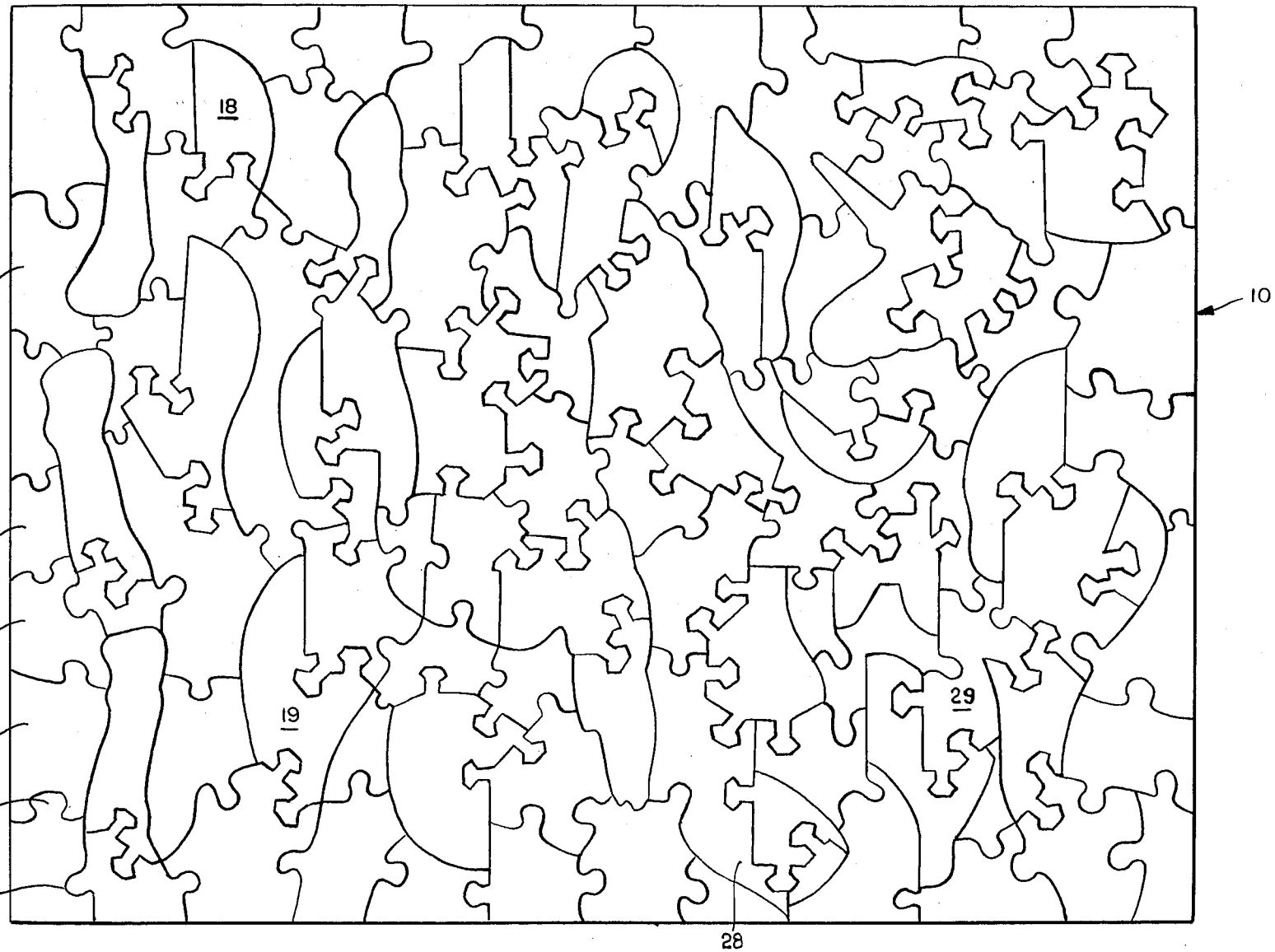
FIG. 1 is a plan view of a jigsaw puzzle constructed in accordance with the invention.

Referring first to FIG. 1, the numeral 10 designates generally a jigsaw puzzle which is formed by cutting a rectangular panel 11 to form a plurality of puzzle pieces 12, 13, 14, etc. Each of the puzzle pieces includes at least one male interlocking projection 15 and at least one female interlocking recess 16, and the male projections of each piece interlock with the female recesses of adjacent pieces to form a solid flat rectangular panel which does not have any slots or openings in it. A suitable picture or scene can be printed on the upper surface of the panel.

Figure 2:
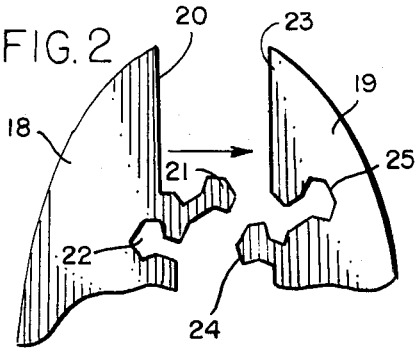
FIGS. 2 and 3 are enlarged fragmentary views of two pieces of the jigsaw puzzle which can be interlocked to form a part having an open-ended slot.
Figure 3:
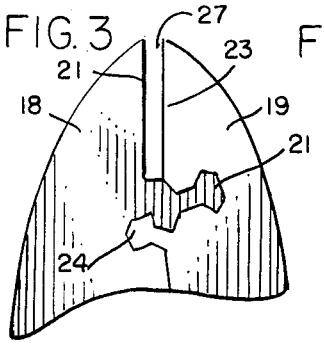

Two puzzle pieces 18 and 19 which occupy non-adjacent positions in the panel of FIG. 1 can be removed from the panel and are shaped so that they can be interlocked as shown in FIGS. 2 and 3. The piece 18 includes a straight edge 20, a male interlock projection 21, and a female interlock recess 22. The puzzle piece 19 includes a straight edge 23, a male projection 24, and a female recess 25. The pieces 18 and 19 are shaped so that the projection 21 interlocks with the recess 25 and the projection 24 interlocks with the recess 22 to form the two-part piece illustrated in FIG. 3. The straight edges 20 and 23 of the pieces 18 and 19, respectively, are spaced apart when the pieces are interlocked to form an open-ended straight slot 27.

Figure 4:
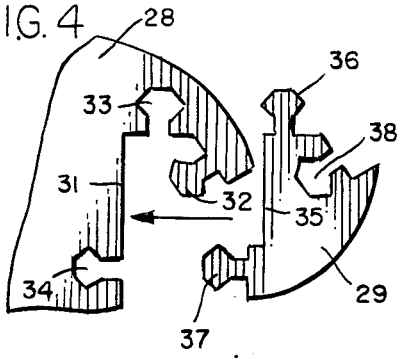
FIGS. 4 and 5 are enlarged fragmentary views of two pieces of the puzzle which can be interlocked to form a part having a closed slot or opening.
Figure 5:
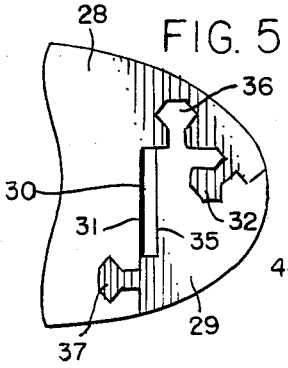

FIGS. 4 and 5 illustrate how two non-adjacent puzzle pieces 28 and 29 can be removed from the panel of FIG. 1 and interlocked to form a two-part piece which has a closed slot or opening 30. The piece 28 includes a straight edge 31, a male projection 32, and female recesses 33 and 34. The piece 29 includes a straight edge 35, male projections 36 and 37, and a female recess 38. When the pieces are interlocked as shown in FIG. 5, the straight edges 31 and 35 are spaced apart to form the opening 30.

Figure 6:
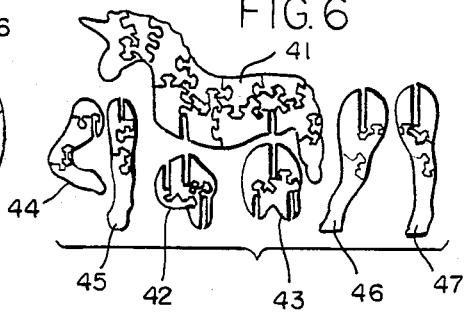
FIG. 6 is a plan view showing various pieces of the puzzle interlocked to form parts for making a three-dimensional figure of a unicorn.

FIG. 6 illustrates a plurality of multiple-piece parts which can be interfitted to form a three-dimensional object. In the particular embodiment illustrated, the parts are interfitted to form a unicorn. The unicorn is formed from a torso and head part 41, a chest part 42, a hip part 43, a pair of front leg parts 44 and 45, and a pair of rear leg parts 46 and 47.

Figure 7:
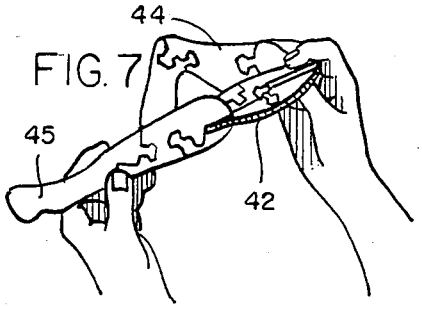
FIG. 7 is a perspective view showing the unicorn being assembled.
Figure 8:
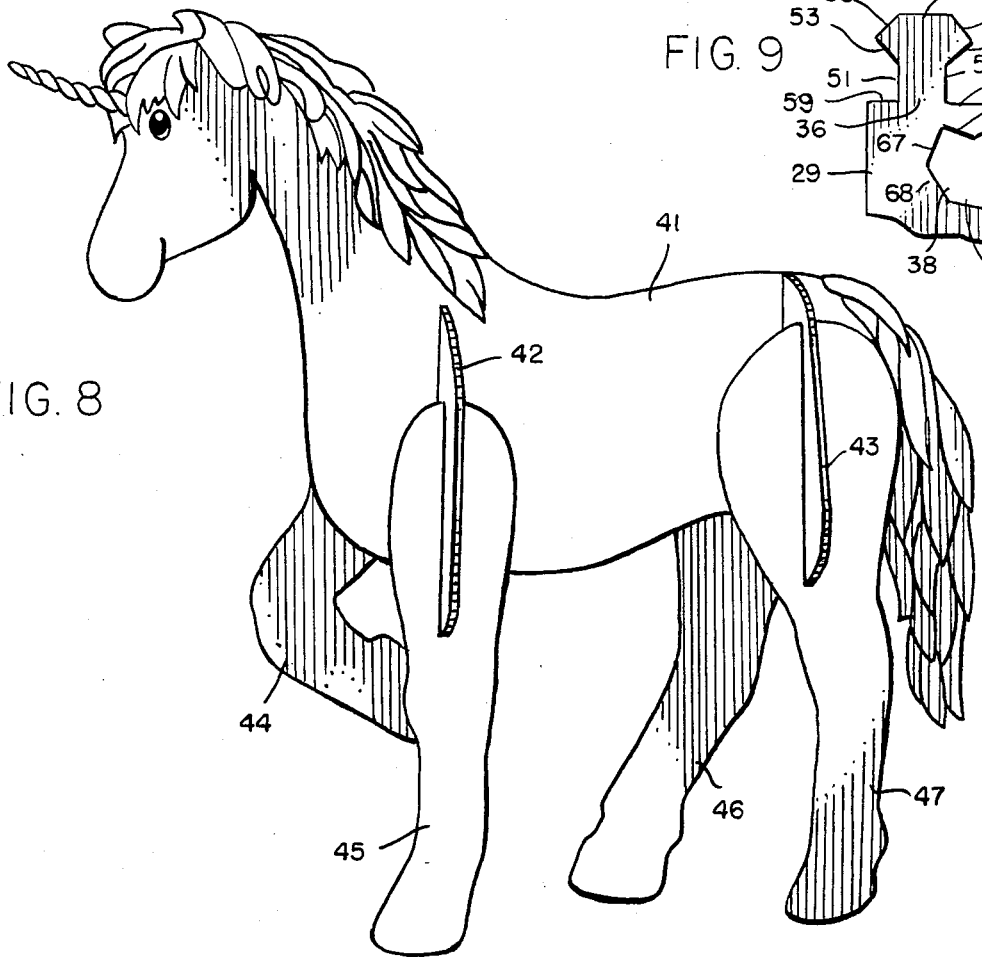
FIG. 8 is a perspective view of the completed unicorn.

Each of the multiple-piece parts 41–47 includes at least two pieces which are interlocked as described previously to form a slot. Each of the legs 44–47 has a single slot. The head and torso part 41 has a pair of slots, one for each of the chest and hip parts. The chest part 42 has three slots, one for the torso part and one for each of the front legs. The hip part 43 also has three slots, one for the torso part and one for each of the rear legs. The parts are interfitted as shown in FIGS. 7 and 8 by interfitting the appropriate slots. The completed object is a free standing or stand-up three-dimensional figure which is supported on a flat surface by the legs 45–47.

The pieces which form the parts 41–47 can be printed with appropriate graphics on their bottom surfaces, i.e., the surfaces which are not visible in FIG. 1 when the pieces are assembled to form the jigsaw puzzle 10. These graphics facilitate the selection of the pieces which form the three-dimensional figure and provide the figure with appropriate coloring.

The dies which are used to cut the puzzle pieces are advantageously laser cut. Laser cutting provides dies with sufficient accuracy so that non-adjacent pieces of the completed puzzle can be interlocked to form the parts of the three-dimensional object.

Figure 9:
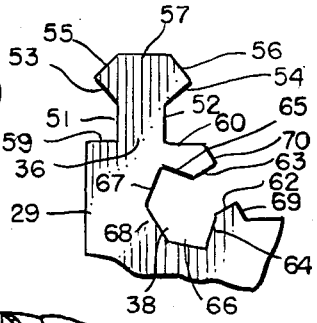
FIG. 9 is an enlarged fragmentary view of one of the pieces of FIG. 4.

The particular shape of the male interlock projections and the female interlock recesses of the pieces which form the slots provides excellent interlocking holding strength which permits the stand-up three-dimensional figure to remain erect after it is assembled. The projections and recesses of most jigsaw puzzles are round or oval or have some definite curvature which does not provide satisfactory interlocking for a free-standing or stand-up three-dimensional figure. The projections and recesses illustrated in FIGS. 2–5 are hexagonal or diamond-shaped and include straight edges and points which create friction which provides a tight, secure interlock. Referring, for example, to FIG. 9, the projection 36 includes a pair of parallel straight side edges 51 and 52 which extend from the main body of the puzzle piece 29. A diamond-shaped interlocking portion is formed by a pair of straight edges 53 and 54 which diverge outwardly from the edges 51 and 52 and by a pair of straight edges 55 and 56 which converge inwardly from the edges 53 and 54. A straight end edge 57 extends between the edges 55 and 56. The parallel edges 51 and 52 extend perpendicularly from a pair of aligned locking edges 59 and 60.

The recess 38 is correspondingly shaped and includes a pair of parallel straight edges 62 and 63, a pair of diverging straight edges 64 and 65, a pair of converging straight edges 66 and 67, and a straight end edge 68. The parallel edges 62 and 63 extend perpendicularly from a pair of aligned locking edges 69 and 70.

The straight edges of the projections and the recesses form mating points which provide a friction fit between the projections and the recesses. This friction fit provides a much stronger interlock than that which is achieved by round or oval interlocks which are used in most jigsaw puzzles. The locking edges of the mating projections and recesses also abut and strengthen the interlock.

In one specific embodiment, the straight edges of the projections and recesses were ¼ inch long, and the locking edges 59 and 60 and 69 and 70 were at least ⅜ inch long.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A jigsaw puzzle comprising a plurality of puzzle pieces which are adapted to interlock together to form a solid surface without openings or slots, each of the puzzle pieces having at least one male interlock projection and at least one female interlock recess, the puzzle pieces including first and second groups of puzzle pieces, each of the puzzle pieces of the first group having a straight edge adjacent a male interlock projection, each of the puzzle pieces of the second group having a straight edge adjacent a female interlock recess, each of the puzzle pieces of the first group being interlockable with one of the puzzle pieces of the second group to form a two-piece part having an open slot defined by the straight edges of the two interlocked pieces, whereby a plurality of said two-piece parts can be interfitted together by said slots to form a three-dimensional part.

2. The puzzle of claim 1 in which each of the male interlock projections of the puzzle pieces of the first group includes a first portion which extends from the puzzle piece and has a pair of parallel sides and a second portion having a pair of straight sides which diverge outwardly from the parallel sides, each of the female interlock recesses of the puzzle pieces of the second group having a first portion which extends inwardly into the puzzle piece and has a pair of parallel sides and a second portion having a pair of straight sides which diverge outwardly from the parallel sides.

3. The puzzle of claim 2 in which said second portion of each of said male interlock projections includes a second pair of straight sides which converge inwardly from the outwardly diverging straight sides to form a pair of points where the straight sides meet, said second portion of each of said female interlock recesses includes a second pair of straight sides which converge inwardly from the outwardly diverging straight sides to form a pair of points where the straight sides meet.

4. A jigsaw puzzle comprising a plurality of puzzle pieces which are adapted to interlock together to form a solid surface without openings or slots, each of the puzzle pieces having at least one male interlock projection and at least one female interlock recess, the puzzle pieces including first and second groups of puzzle pieces, each of the puzzle pieces of the first group having a straight edge adjacent a male interlock projection, the male interlock projection of each of the puzzle pieces of the first group including a first portion which extends from the puzzle piece and has a pair of parallel sides and a second portion having a pair of straight sides which diverge outwardly from the parallel sides and a pair of straight sides which converge inwardly from the outwardly diverging straight sides to form a pair of points where the straight sides meet, each of the puzzle pieces of the second group having a straight edge adjacent a female interlock recess, the female interlock recess of each of the puzzle pieces of the second group including a first portion which extends inwardly into the puzzle piece and has a pair of parallel sides and a second portion having a pair of straight sides which diverge outwardly from the parallel sides and a pair of straight sides which converge inwardly from the outwardly diverging straight sides to form a pair of points where the straight sides meet, the male interlock projection of each of the puzzle pieces of the first group being interlockable with the female interlock recess of each of the puzzle pieces of the second group to form a two-part member having an open slot defined by the straight edges of the two interlocked pieces whereby a plurality of said two-part members can be interfitted together by said slots to form a three-dimensional part.

* * * * *